United States Patent [19]

Graser

[11] 3,974,911

[45] Aug. 17, 1976

[54] CARRIER WITH DROP DOWN PARTITION

[75] Inventor: Earl J. Graser, Monroe, La.

[73] Assignee: Olinkraft, Inc., West Monroe, La.

[22] Filed: Sept. 30, 1974

[21] Appl. No.: 510,681

[52] U.S. Cl. ..... 206/141; 206/193; 206/491; 229/15; 229/27; 229/52 B

[51] Int. Cl.[2] ..... B65D 5/48

[58] Field of Search ..... 229/27.28, 15, 41 R, 229/41 B; 206/491, 193, 141

[56] References Cited

UNITED STATES PATENTS

| | | | |
|---|---|---|---|
| 2,284,815 | 6/1942 | Grimm | 229/27 |
| 2,296,228 | 9/1942 | Powell | 229/27 |
| 2,382,844 | 8/1945 | Arneson | 229/27 |
| 3,025,630 | 3/1962 | Silvey | 229/27 |
| 3,744,703 | 7/1973 | Mortenson | 229/27 |

*Primary Examiner*—William Price
*Assistant Examiner*—Joseph M. Moy
*Attorney, Agent, or Firm*—Norvell E. Von Behren

[57] ABSTRACT

A carrier for containing a plurality of bottles or the like has a pair of overlapping top panels wherein the inner top panel has a partition joined by a hinge thereto. The hinge is such that the partition drops into a vertical position forming a divider between bottles which are later assembled therein.

9 Claims, 7 Drawing Figures

CARRIER WITH DROP DOWN PARTITION

BACKGROUND OF THE INVENTION

1. Field of the Invention

The invention relates to carriers or cartons made from fiberboard or the like for containing a plurality of fragile articles, such as twelve bottles, for storage, handling and the like.

2. Description of the Prior Art

The prior art, as exemplified in U.S. Pat. Nos. 2,684,178, 2,830,726, 3,394,800 and 3,554,402, contains a number of carriers having partitions between articles therein. Several prior carriers have partitions which are folded down from one of a pair of top panels to extend between articles within the carrier; however, such prior art partitions require a separate step of folding the partition downward and sometimes securing the partition during the assembly of articles within the carrier.

SUMMARY OF THE INVENTION

The invention is summarized in that a carrier for a plurality of fragile articles includes a bottom panel; a pair of opposite side panels; a pair of opposite end closing means; first and second overlapping top panels; the bottom panels, the pair of opposite side panels, the pair of opposite end closing means, and the first and second overlapping top panels interconnected to form a carton for receiving and enclosing the plurality of fragile articles; and the inside top panel of the first and second overlapping top panels having a partition and a hinge formed therein joining the partition to the inside top panel wherein the hinge is such that the partition drops into a vertically extending position forming separated portions within the carrier for receiving fragile articles.

An object of the invention is to construct a carrier which, when opened from a folded condition, eliminates the necessity of inserting dividers or partitions in the carrier prior to assembly of fragile articles therein.

Another object of the invention is to provide a carrier with a partition which automatically drops down into position when the carrier body is folded open to form a divider therein.

An advantage of the invention is that the hinge connecting a partition to a top panel of a carrier is formed such that the partition pivots down into a vertical position when the carrier is folded open.

Other objects and advantages of the invention will become apparent from the description of the preferred embodiment taken in conjunction with the accompanying drawings.

DESCRIPTION OF THE PREFERRED EMBODIMENT

Figure 1:
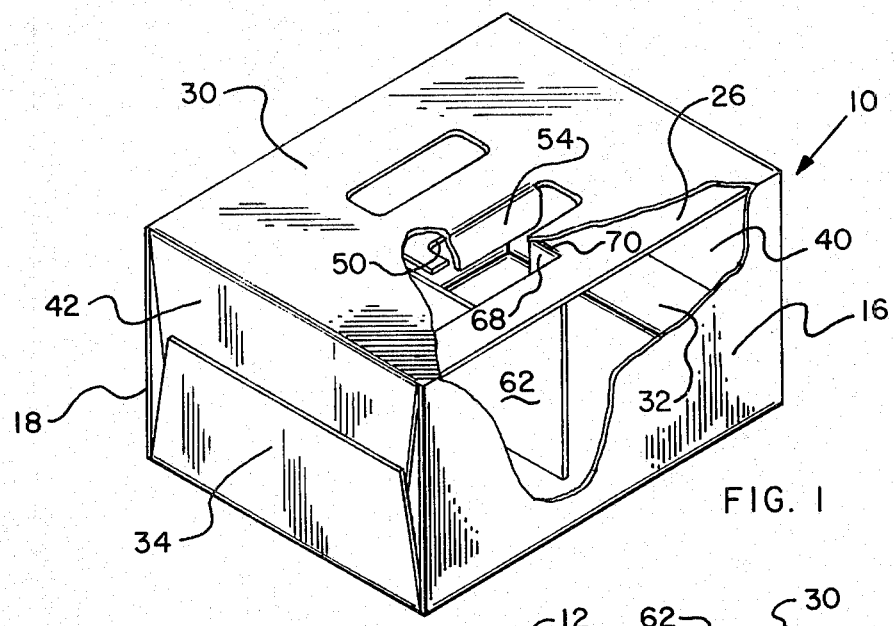
FIG. 1 is a perspective view, partially broken away, of a carrier in accordance with the invention.
Figure 6:
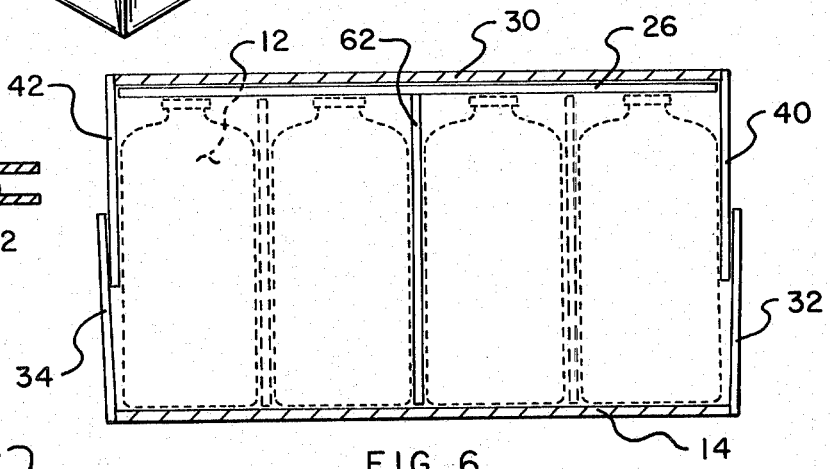
FIG. 6 is a front cross section view of the carrier of FIG. 1 with the assembled articles shown in phanton.
Figure 7:
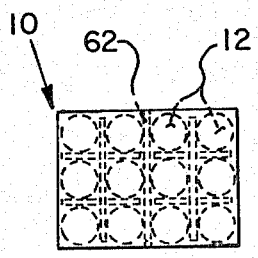
FIG. 7 is a top view of the carrier of FIG. 6.

As illustrated in FIG. 1 in the invention is embodied in a carton or carrier, indicated generally at 10, for containing a plurality of fragile articles, such as twelve bottles 12 (FIGS. 5, 6 and 7) during transportation and storage and the like. The bottles 12 are arranged in groups of six in separate parallel assembly lines wherein each group of six has two adjacent parallel rows of three adjacent bottles with the bottles in the two parallel rows being abreast. Conventional dividers 13 are positioned between the bottles in each group of six bottles in both assembly lines.

Figure 2:
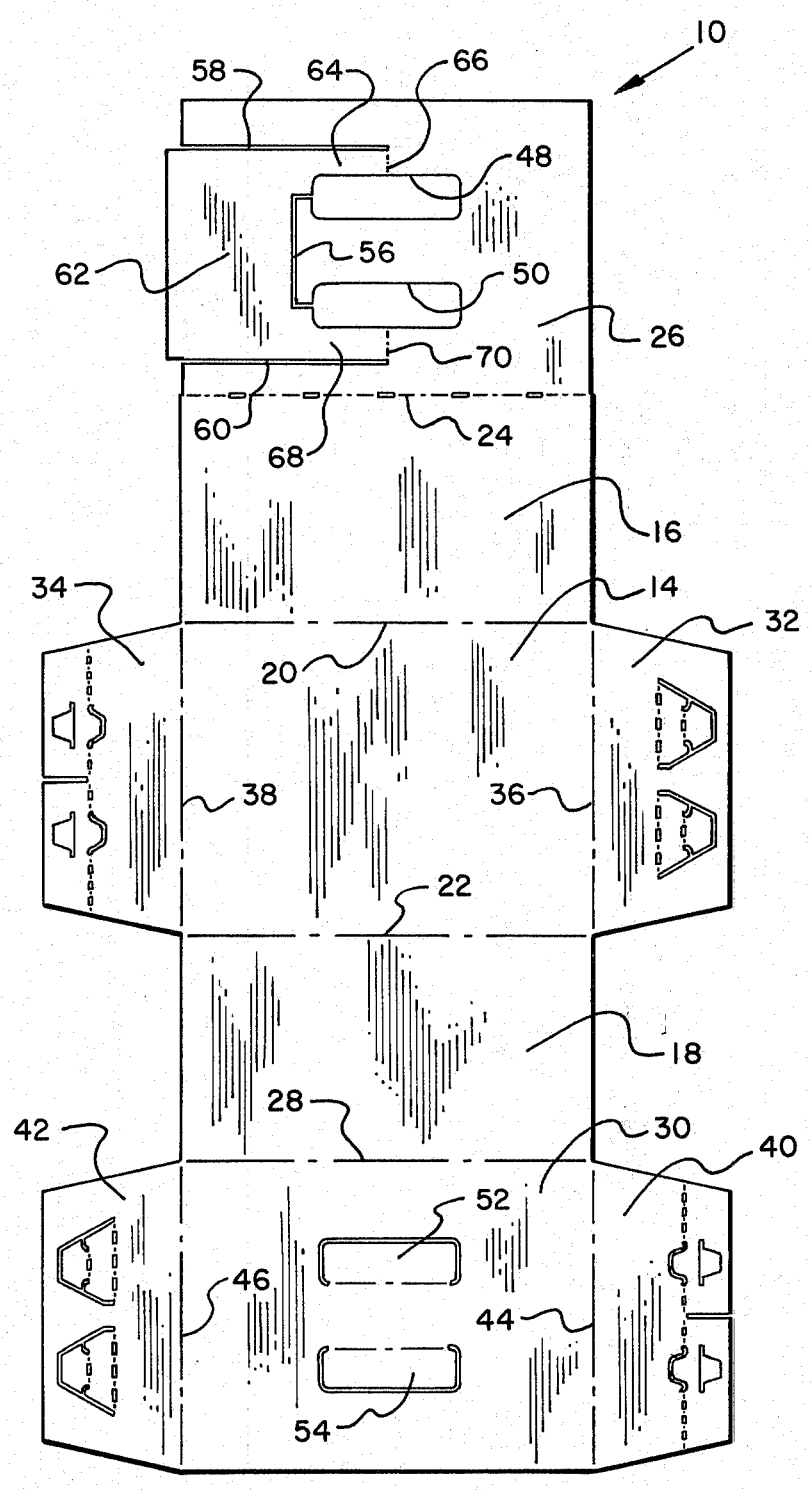
FIG. 2 is a plan view of a blank for forming the carrier of FIG. 1.

As shown in FIG. 2 the carrier 10 is formed from a integral blank of fiberboard or the like and has a bottom panel 14, a pair of side panels 16 and 18 having bottom edges joined at respective score lines 20 and 22 to opposite side edges of the bottom panel 14. The top edge of the side panel 16 is joined at a score line 24 to an inside top panel 26 while the top edge of the side panel 18 is joined at a score line 28 to a side edge of an exterior top panel 30. End flaps 32 and 34 are joined at respective score lines 36 and 38 to the opposite end edges of the bottom panel 14, and end flaps 40 and 42 are joined at respective score lines 44 and 46 to opposite end edges of the exterior top panel 30. Finger openings 48 and 50 are formed in the interior top panel 26, and bend-in finger tabs 52 and 54 are severed in the exterior top panel 30 for alignment with the openings 48 and 50 such that the tabs 52 and 54 may be bent through the openings 48 and 50 to form a handle portion for the carrier. The end flaps 32, 34, 40, and 42, may be provided with interlocking tab devices such that the flap 32 can be secured to the flap 40 and the flap 34 can be secured to the flap 42.

The interior top panel 26 has die cuts 56, 58, and 60 forming a partition 62. A strip-like upper side portion 64 of the partition 62 formed between the cut line 58 and the opening 48 is attached at the top edge thereof by a score line, hinge or hinge portion 66 to the rest of the interior top panel 26. A similar strip-like portion 68 on the opposite upper side of the partition 62 is attached at a score line, hinge, or hinge portion 70 to the interior top panel 26. The hinges 66 and 70 are aligned along a common axis which, is parallel to and centrally disposed between the opposite end edges of the interior top panel 26.

The hinges 66 and 70 are formed such that the partition 62 drops into a position extending sufficiently vertically to form separated spaces 72 and 74 (FIG. 5) extending from the partition 62 to respective opposite ends of the carrier 10 for receiving respective groups of six bottles. The strip-like portions 64 and 68 and thus the hinges 66 and 70 have widths which are substantially less than one-half the width of the partition 62, and preferrably the sum of the widths of the portions 64 and 68 is less than one-half the width of the partition 62 such that fiberboard portions forming the hinges 66 and 70 are sufficiently weak that the weight of the partition under the force of gravity will pivot the partition 62 about the hinges 66 and 70 to a downward extending position.

Figure 3:
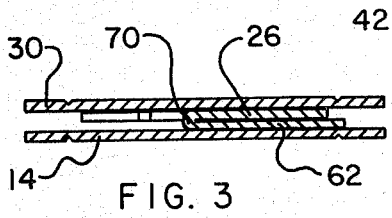
FIG. 3 is a front cross section view of the carrier of FIG. 1 in a folded position.

The material from which the carrier 10 is formed is selected to form hinges 66 and 70 which are partially resilient. The partition 62 is bent 180° about the hinges 66 and 70 against the inside surface of the interior top panel 26. Then the carrier 10 is folded into a flat collapsed condition as shown in FIG. 3 with the exterior top panel 30 overlapping and secured, such as by gluing or the like, to the interior top panel 26 and with overlapping top panels 26 and 30 on top and the bottom panel 14 on bottom. The partition 62 is free of (i.e. not attached to even though engaged by or sandwiched between) the bottom panel 14, the side panels 16 and 18, and the end flaps 32, 34, 40 and 42. The partial resilience of the hinges 66 and 70 is particularly selected to return the partition to the vertical position when the carrier 10 is unfolded from its flat condition.

Figure 5:
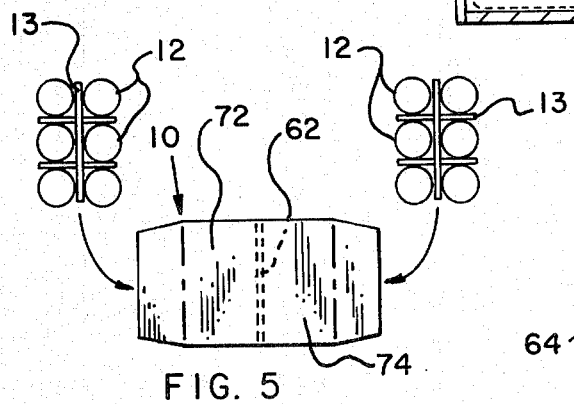
FIG. 5 is a plan view illustrating assembly of articles in the carrier of FIG. 4.
Figure 4:
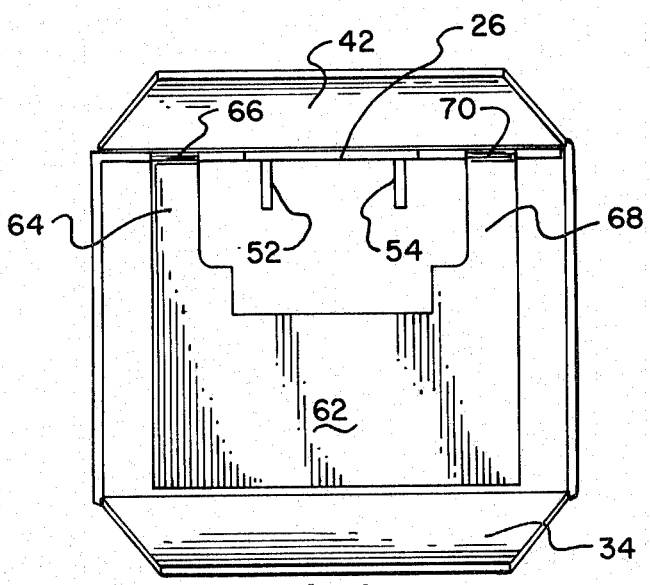
FIG. 4 is a side view of the carrier of FIG. 1 after being unfolded.

In use of the carrier 10, the carrier 10 is unfolded from its flat condition to the open condition as shown in FIGS. 4 and 5 with the end flaps 32, 34, 40 and 42 open. The weight of the partition 62 together with the resilient of the fiberboard at the hinges 66 and 70 causes the partition 62 to drop or pivot to a vertically extending position within the carrier forming a divider between portions 72 and 74 of the carrier 10. Then as illustrated in FIG. 5 a group of six bottles may be inserted sideways into each open end of the carrier 10 such that the adjacent rows of bottles in respective groups of six bottles abut the partition 62 from opposite sides of the partition. The assembly of the bottles 12 into the carton is completed by securing end flap 32 to the end flap 40 and securing the end flap 34 to end flap 42 by use of the tab devices shown in FIG. 2 or by other suitable means such as gluing. The partition 62 protects the adjoining rows of bottles from breaking or the like during transportation or handling.

It is partically advantageous that the hinges 66 and 70 are formed such that the partition drops or pivots to a vertically extending position when the carrier 10 is unfolded from its flat position. This illiminates the necessity for providing a separate bending step after unfolding or the necessity of insertion of a separate partition between the groups of six bottles as they are inserted into the carrier 10.

The strip-like portions 64 and 68 having widths substantially less than one-half the width of the partition 62 provides an easy manufactured weakness in the hinges 66 and 70 which allows the force of gravity to aid in dropping the partition 62. Also the resilient nature of the hinges 66 and 70 together with the preformed 180° bend about the hinges 66 and 70 aids in pivoting the partition 62 downward. The particular combination of the narrow strip-like portions 64 and 68 and the partial resilience of the hinges 66 and 70 bent 180° results in the partition 26 pivoting substantially to a vertical position; thus other bending steps and separate insertion of partitions are eliminated.

Since many modifications, changes in detail and variations may be made to the present carrier, it is intended that all matter in the foregoing description and in the accompanying drawings be interpreted as illustrative and not in a limiting sense.

What is claimed is:

1. A carrier for a plurality of fragile articles comprising a bottom panel;

a pair of opposite side panels;

a pair of opposite end closing means;

first and second overlapping top panels;

said bottom panel, said pair of opposite side panels, said pair of opposite end closing means, and said first and second overlapping top panels being interconnected in a collapsed flat condition wherein said overlapping top panels are on top and wherein said bottom panel is on bottom;

the inside top panel of said first and second overlapping top panels having a partition and hinge formed therein free of the bottom panel, the pair of side panels and the end closing means; and said hinge joining the partition to the inside top panel and being such that, when the carrier is opened from the flat condition, the partition freely drops into a position extending sufficiently vertically to form separated portions within the carrier for receiving fragile articles in the separated portions.

2. A carrier for a plurality of fragile articles as claimed in claim 1, wherein the partition and hinge are such that the force of gravity at least aids in dropping the partition into the vertically extending position.

3. A carrier for a plurality of fragile articles as claimed in claim 1, wherein the inside top panel and the partition are formed from an integral fiberboard which is resilient, and the hinge is formed by bending the partition through an angle of about 180° whereby the resilience of the fiberboard at least aids in dropping the partition into the vertically extending position.

4. A carrier for a plurality of fragile articles as claimed in claim 3 wherein the partition and hinge are such that the force of gravity at least aids in dropping the partition into the vertically extending position.

5. A carrier for a plurality of fragile articles as claimed in claim 1 wherein said inside top panel, said partition and said hinge are formed from an integral fiberboard, said partition has a width extending across a substantial portion of the width of the carrier;

said partition has a pair of upper strip-like portions, said hinge includes a pair of hinge portions integrally joining the respective upper strip-like portions to the inside top panel, and said upper strip-like portions have widths substantially less than one-half the width of the partition are such that the hinge portions are readily bent by the weight of the partition.

6. A carrier for a plurality of fragile articles as claimed in claim 5 wherein the fiberboard is resilient, and the partition is bent about 180° about the hinge portions whereby the resilience of the fiberboard urges the partition into a vertical position.

7. A carrier for a plurality of fragile articles as claimed in claim 5 wherein the strip-like portions are formed at upper opposite side corners of the partition.

8. A carrier for a plurality of fragile articles as claimed in claim 5 wherein the sum of the widths of said upper strip-like portions is less than one-half the width of the partition.

9. A carrier for twelve bottles wherein the twelve bottles are arranged in two groups of six bottles each and each of the groups has a divider separating the six bottles of each group, said carrier comprising an integral fiberboard blank including a bottom panel, a pair of opposite side panels joined to the bottom panel at opposite side edges of the bottom panel, an interior top panel joined to the top edge of one of the pair of side panels, an exterior top panel joined to the top edge of the other of the pair of side panels, said interior top panel having a pair of finger openings formed centrally therein, a pair of finger tabs formed centrally in the exterior top panel for alignment with the finger openings in the interior top panel, a first pair of end flaps joined to the opposite end edges of the bottom panel, a second pair of end flaps joined to the opposite end edges of the exterior top panel, a partition for pivoting into a vertical position formed from the interior top panel and having a pair of strip-like portions joining the upper opposite corners of the partition to the rest of the interior top panel, a pair of score lines forming hinges at the junction of the pair of strip-like portions to the rest of the interior top panel, said exterior top panel being secured to the interior top panel, said pair of strip-like portions having widths which have a sum less than one-half the width of the partition, said partition being bent 180° about the pair of score lines into engagement with the interior surface of the rest of the interior top panel, said hinges having a resilience which together with the force of gravity tend to pivot the partition down to a substantially vertical position when the carrier is unfolded from a flat condition to an open condition, and said hinges extending along a central axis dividing the carrier into two portions for receiving respective groups of six bottles into respective open ends thereof, whereby said partition separates the respective groups of six bottles.

* * * * *

UNITED STATES PATENT OFFICE

CERTIFICATE OF CORRECTION

PATENT NO. : 3,974,911

DATED : August 17, 1976

INVENTOR(S) : Earl J. Graser

It is certified that error appears in the above-identified patent and that said Letters Patent are hereby corrected as shown below:

Column 1, line 67 - delete "phanton" and insert in place thereof -- phantom --.

Column 2, line 4 - after Fig. 1 delete -- in --.

Column 3, line 16 - delete "resilient" and insert -- resilience--.

Column 3, line 31 - delete "partically" and insert in place thereof -- particularly --.

Column 3, line 34 - delete "illiminates" and insert in place thereof -- eliminates--.

Signed and Sealed this

Seventh Day of December 1976

[SEAL]

*Attest:*

RUTH C. MASON
*Attesting Officer*

C. MARSHALL DANN
*Commissioner of Patents and Trademarks*